US005192032A

United States Patent [19]

Brouwer et al.

[11] Patent Number: 5,192,032

[45] Date of Patent: Mar. 9, 1993

[54] AUTOMATIC WINDING UNIT

[75] Inventors: Charles W. Brouwer, Greensboro; Roger D. Lang, Gibsonville; Thomas W. Perrino, Burlington, all of N.C.

[73] Assignee: John Brown Inc., West Warwick, R.I.

[21] Appl. No.: 607,653

[22] Filed: Oct. 31, 1990

[51] Int. Cl.[5] ..... B65H 67/04

[52] U.S. Cl. ..... 242/35.5 A; 242/18 R; 242/18 PW

[58] Field of Search ..... 242/35.5 A, 35.5 R, 242/18 R, 18 PW

[56] References Cited

U.S. PATENT DOCUMENTS

| | | | |
|---|---|---|---|
| 3,559,903 | 2/1971 | McDermott et al. | 242/18 PW |
| 3,791,126 | 2/1974 | Kose et al. | 242/35.5 A |
| 3,816,990 | 6/1974 | Hoffman et al. | 242/35.5 A X |
| 3,820,730 | 6/1974 | Endo et al. | 242/35.5 A X |
| 3,908,918 | 9/1975 | Bergstrom | 242/18 PW X |
| 3,915,398 | 10/1975 | Corl | 242/35.5 A |
| 4,007,882 | 2/1977 | Isoard | 242/35.5 A X |
| 4,023,741 | 5/1977 | Schar | 242/18 PW X |
| 4,052,017 | 10/1977 | Schar | 242/35.5 A |
| 4,069,983 | 1/1978 | Muramatsu et al. | 242/18 PW |
| 4,079,898 | 3/1978 | Murakami et al. | 242/35.5 A |
| 4,093,133 | 6/1978 | Hoffmann et al. | 242/18 PW |
| 4,108,388 | 8/1978 | Schar | 242/18 PW X |
| 4,340,187 | 7/1982 | Schippers et al. | 242/35.5 A |
| 4,351,492 | 9/1982 | Aoyama et al. | 242/18 PW X |
| 4,427,158 | 1/1984 | Conrad | 242/35.5 A |
| 4,496,109 | 1/1985 | Cardell | 242/18 PW |
| 4,561,602 | 12/1985 | Schippers | 242/18 PW X |
| 4,621,778 | 11/1986 | Paravella et al. | 242/35.5 A |
| 4,638,955 | 1/1987 | Schippers et al. | 242/18 PW |

*Primary Examiner*—Stanley N. Gilreath
*Attorney, Agent, or Firm*—Breiner & Breiner

[57] ABSTRACT

A winding unit having intelligence built into the winder and automation of the winder are described. The winders automatically perform functions such as open the roller bail of the winder, release a package on a winding spindle, secure a new package tube on the spindle, and set the machine to a pre-set speed through activation of a single switch. The winders are utilized either manually or with automation which will interface with the winder, cut and aspirate a strand, remove a full package from a spindle on the winding unit, install a new package tube on the spindle, and then re-thread the spindle. Since the intelligence is divided between the winding unit and the robot, the robot can be relatively simple in construction.

13 Claims, 8 Drawing Sheets 78
74
76

SS
S
SS
SS
SS
12
20
12
26
10
72
24
22
68
68
66
12
12
70
60
14
64
62
12
26
24
20
40

30
P
68
T
84
82
80

AUTOMATIC WINDING UNIT

FIELD OF INVENTION

This invention is directed to improved strand winding units. More particularly, the invention relates to a strand winding unit designed for automation and to the combination of the strand winding unit and automation for servicing the winding unit. The automation can be a robot.

BACKGROUND OF INVENTION

Conventional winding units for winding strand materials, such as polypropylene and the like, have a plurality of stations comprising a strand supply, guide/-traverse means, and a spindle-package arrangement for taking up the strand material. These units are conventionally maintained by a skilled operator who watches for filled packages on the spindles and, when a filled package is observed, the individual machine is stopped, the filled package removed, and then the machine is restarted to resume winding of the strand supply on an empty spindle. The winding unit can also be closed down as a complete unit for periodic removal of filled packages from each of the winding stations of the unit, followed by restarting of the winding operation, again as a complete unit. In each of these different modes of operation, the winding is more labor intensive than desired, and/or the winding units are not efficiently employed.

Automatic winding units have been proposed and described in the art to make the winding units less labor intensive. These automated units, however, are relatively complex and therefore costly and difficult to service and maintain. As a result, automated units have not reached any substantial commercial success.

Accordingly, there is a need for automatic strand winding units capable of servicing a winding operation suitable for, inter alia, taking up a plurality of strands, such as polypropylene and the like strands, wherein the doffing of a filled package from a spindle, rethreading, and re-starting of the winding operation is done automatically, and wherein the mechanism is simple in design, operation, and maintenance. The present invention provides such winding units.

SUMMARY OF INVENTION

The present invention provides an improved winding unit for the winding of strand material, such as polypropylene, designed for automation. A plurality of winding units are compactly arranged to permit servicing of all of the units by a common robot. A robot for servicing the winding units is also provided. According to the invention, a robot comes to a spindle carrying a filled package to be doffed and aligns itself with the spindle. The lower part of the robot is connected to a vacuum source carried by the winding unit. An arm of the robot comes into the strand line at a point immediately before it reaches the spindle, cuts and aspirates the strand, and sends a signal to the spindle control to begin the doff sequence. The signal is preferably in the form of operating a valve. At that point the spindle doffing sequence begins. The roller bail on the guide/traverse means of the winding unit opens to the doff position, the motor power of the unit is disengaged, a brake is applied to the spindle, and a chuck on the spindle which carries the package releases the package. In a timed relationship, the robot removes the full package.

The robot, after removing the filled package, indexes and places an empty tube for receiving the strand onto the spindle, and initiates a re-start sequence by moving the signal valve to its original position. The roller bail closes, the brake releases, the chuck is closed, and the spindle assumes a preset winding start-up speed. Thereafter, the robot takes the strand that it is holding in the aspirator and carries the strand so that it passes by the front of the spindle where it engages into a thread-up flange on the spindle end. The thread-up flange cuts the strand, winds the tail, and begins winding a new package. The robot then proceeds to deposit the full package on, for example, a conveyor or overhead trolley, and picks up a new empty tube. It then moves to another spindle to begin the doffing sequence on a subsequent spindle.

The winding units of this invention are compact, simple in design, and easy to operate primarily through the use of pneumatic tension means for controlling the strand tension, pneumatic package pressure means for controlling package shape, and a combination pneumatic brake and chuck release for stopping the spindle and releasing the package when doffing. Both the tension and the package pressures are regulated for a multiplicity of spindles from a central point at the end of a line of winding units. Thus, air is fed from a line source through regulators to a multiplicity of spindles, each on an individual winding unit. There is one regulator for the tension control and a second regulator for the package pressure control. Two air cylinders are utilized for each winding unit, one cylinder is connected so as to apply force between spindle and the roller bail, and a second cylinder is connected to apply force to the compensator arm of the winding unit, thereby controlling the tension on the strand. Controlled pneumatic pressure is, therefore, fed to at least one side of each cylinder.

These same two air cylinders will effect other functions simply by modulating the pressure to the cylinders. Thus, applying high pressure air to the tension cylinder will drive the compensator arm to a lower position, essential during package removal. Applying high pressure to the opposite side of the package pressure cylinder will create the ability to reverse the direction of the force applied and to move the roller bail to the doff position, also essential during package removal.

The combination pneumatic brake and chuck release, above referred to, permits convenient braking and doffing of a package. When air is introduced into the combined brake-clutch device, air is first introduced to the brake function and subsequently introduced with a delay to the chuck release cylinder. The air moves a first cylinder into contact with a brake on the spindle, and the chuck release system hits expander rods on the spindle to release the chuck. The operation is then reversed. Since removal of air from the system creates an opposite effect, it first releases the chuck, gripping the empty core, and releases the brake which allows for free rotation for the resumption of strand winding on a new package. The selective operation of the brake and then the chuck release is through the simple expediency of having the air flow line to the brake of larger capacity than the flow line to the chuck release.

The drive means of the system of this invention is designed in order that when power is interrupted and then re-applied, the drive automatically places the spindle at a pre-selected speed—normally about five percent higher than operating line speed. In the preferred design, when the compensator of the winding unit which controls strand tension and the drive speed passes through horizontal, the voltage output is also passing from a negative voltage to a positive voltage. When it crosses zero, the drive assumes a normal operating winding mode. This permits a simplified automated system.

The spindle control system that integrates all of the functions of the winding system, in addition to the tension regulator and the package pressure regulator, preferably includes a third frame-out regulator. The third regulator, preferably, as are the first two regulators, is located at a central point at the end of a line of units and air is fed from each regulator to a multiplicity of spindles.

During operation of the winding units according to this invention, in the strand winding mode the strand tension cylinder receives a regulated pressure to control the tension. The brake and chuck actuation means are inactive, and the package pressure cylinder preferably has two air pressures applied to it through regulators so that the motion of the spindle frame is cushioned by means of a differential pressure producing a definitive regulated force, creating a given package pressure. The doffing of a full package, which can be done either manually or with a robot, will be described using a robot. An actuating valve, such as a toggle or push valve, is moved to the doff mode. In the doff mode, air is introduced to an interface switch which opens an electrical circuit, thereby removing power from the motor. Air is simultaneously fed to the strand tensioning cylinder, placing higher pressure air on it which forces the compensator arm to its lowest position. Concurrently air is introduced to the brake-chuck actuation means which sequentially operates the brake and chuck release as above described. Also simultaneously, the air is relieved from the rear of the package pressure cylinder, forcing the spindle to raise from the package wind position and assume a doffing position. The mechanism now stands ready for the robot to doff.

The robot, after doffing a full package and placing a new empty tube on the spindle, signals the spindle again by returning the actuating valve to its first position. When this occurs, the whole process is reversed. The spindle frame/roller bail assembly moves toward the winding position. The yarn tension cylinder assumes normal pressures to give normal winding tensions. The chuck air is relieved so that the brake is released, and the chuck closes.

At this point in a preferred system, the yarn compensator arm is restrained from freedom of motion by a hold-down assembly. The hold-down assembly is of sufficient force to restrain release by the robot aspirator, but will release when the spindle thread-up flange is engaged. The unit is then ready for the robot to begin the actual winding. Strand is introduced to the thread-up flange, which exerts sufficient force to move the compensator off the hold-down means and through the horizontal position where the drive now enters the winding mode, and the operation is complete. A tail has been built and a new package started.

The entire system is compact and, primarily because of its pneumatic functions, is simple in operation and maintenance. Additionally, the controls of the roller-bail pressure on the spindle with the air cylinder, which also provides for moving the spindle and roller-bail assemblies between a frame-in and frame-out position, provides an accurate bail pressure control resulting in a tight, compact strand package. The strand tension can be controlled on a plurality of units simply by adjusting one line pressure.

Having described the invention in general terms, the presently preferred embodiment will be described with reference to the drawing.

THE DRAWING AND PRESENTLY PREFERRED EMBODIMENT

Figures 1, 1A, 2:
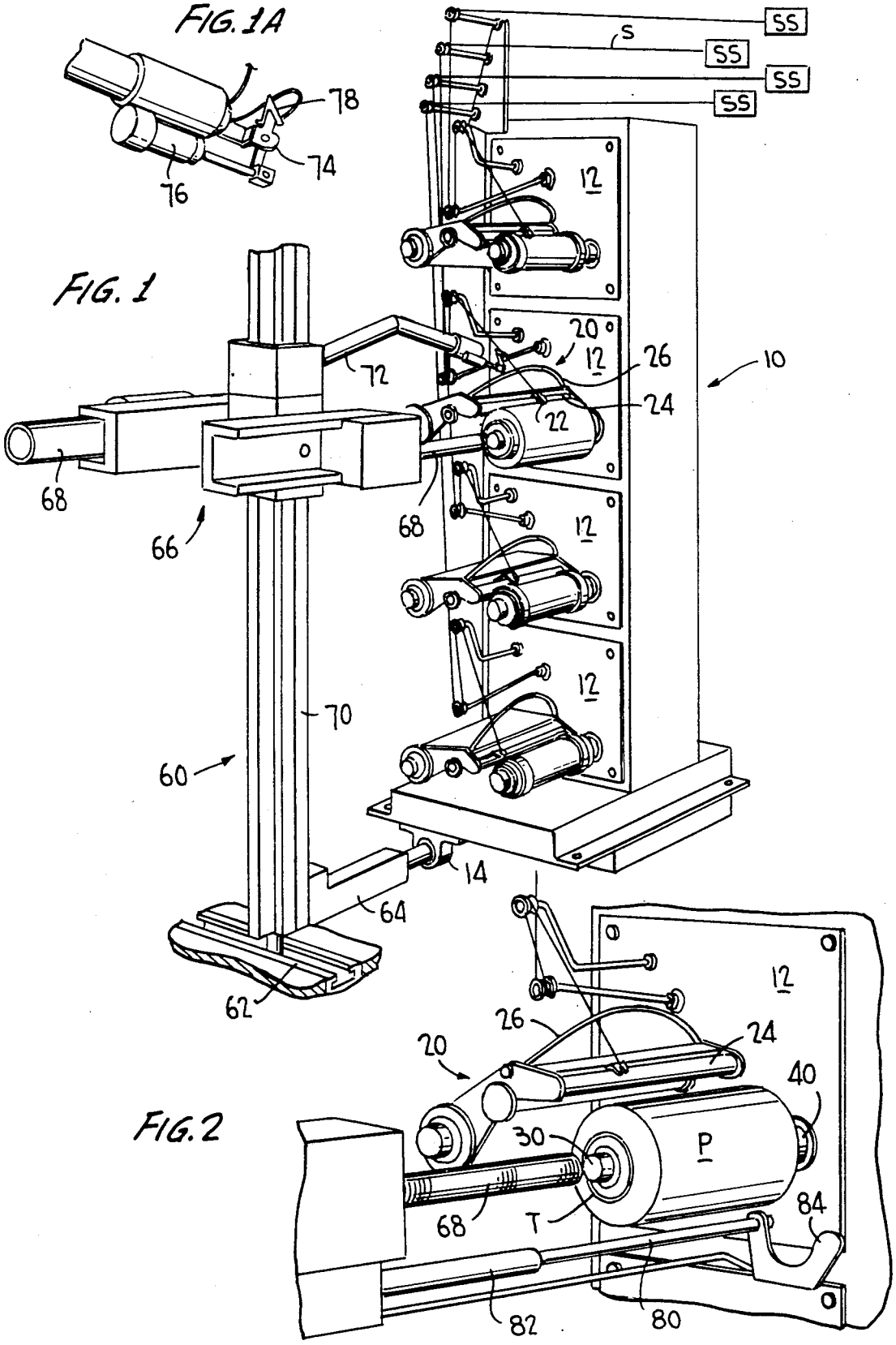
FIG. 1 is a perspective view of four winding units vertically arranged on a common frame showing a robot aligned with a spindle carrying a full strand package which is to be doffed.
FIG. 1A is a perspective view of a robot arm of the robot of FIG. 1 carrying an aspirator and a strand cut mechanism.
FIG. 2 is a perspective view of the spindle of FIG. 1 to be doffed showing part of the roller-bail assembly and part of the robot positioned to remove a strand package.
Figure 6:
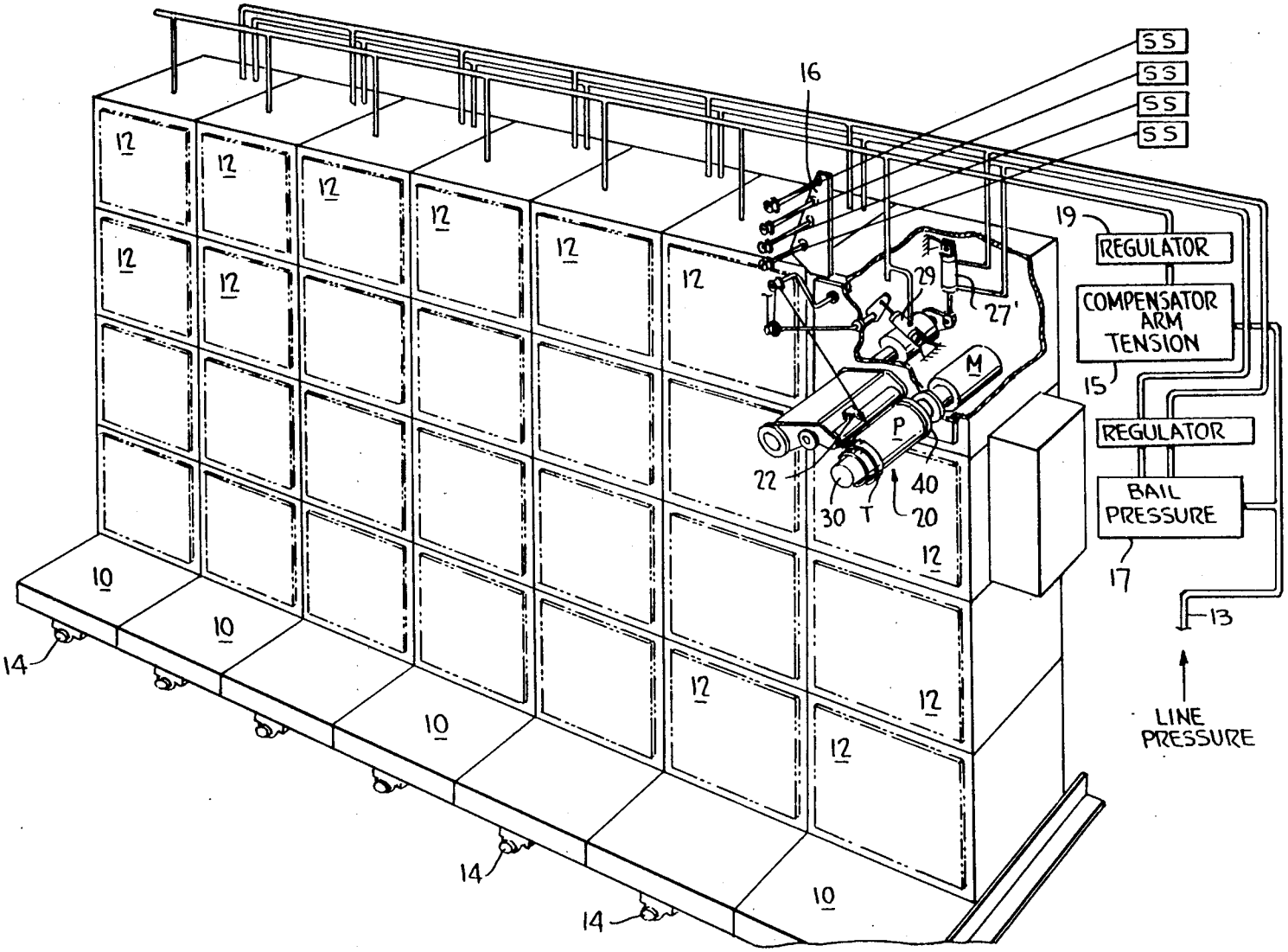
FIG. 6 is an in-line perspective view partly broken-away of a bank of winding units to be serviced by a single robot, not shown.

Referring first primarily to FIGS. 1 and 6 of the drawing, a bank of seven winders 10, each having four vertically arranged winding units 12, are shown. Each winder 10 has an individual vacuum source 14 at the front of the winder which is connected to each of winding units 12. Winding units 12, in turn, include an individual strand supply SS which feeds a strand S to winding unit 12 over guide rolls 16 to a guide/traverse means 20 for winding, as a package P, on a tube T carried by a spindle 30. Spindle 30 is driven by an electric motor M through a brake and clutch means 40. The guide/-traverse means 20 includes strand guide 22 and roller bail 24 carrying a bow arm 26 to help control the strand as it is traversed.

Figure 7B:
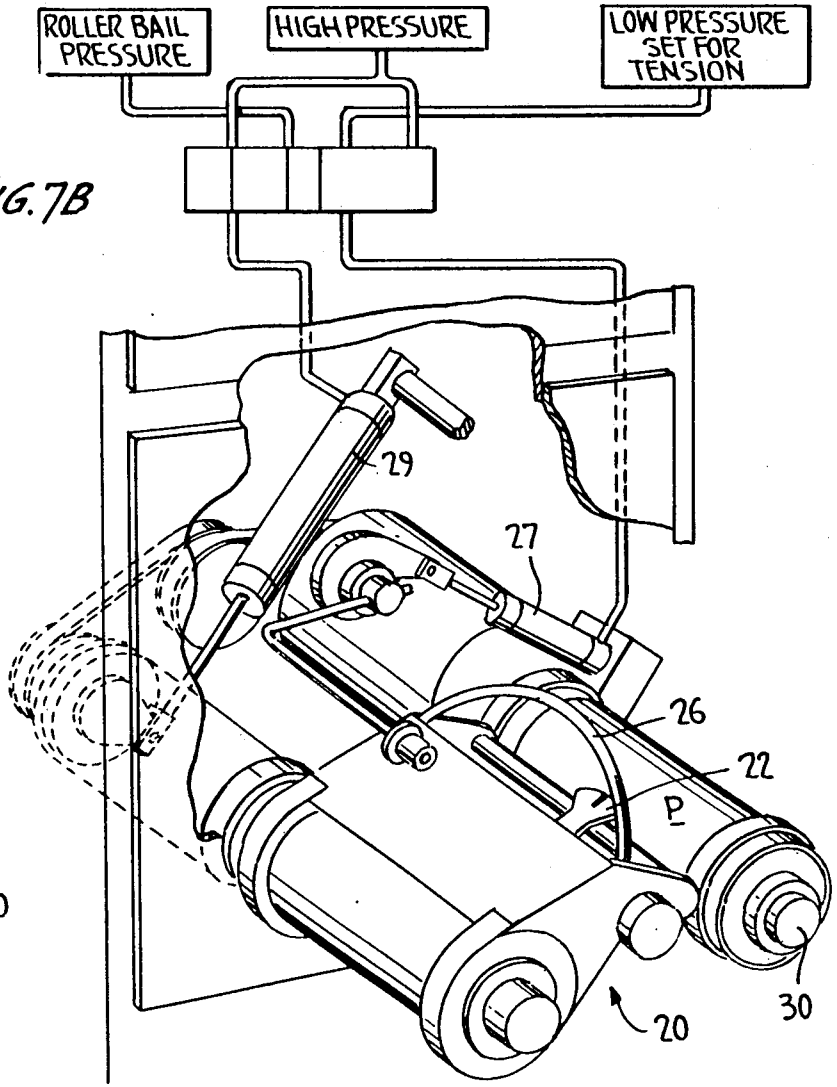
FIGS. 7A and 7B are schematic views of one spindle assembly in each of the doff and wind mode.
Figure 7A:
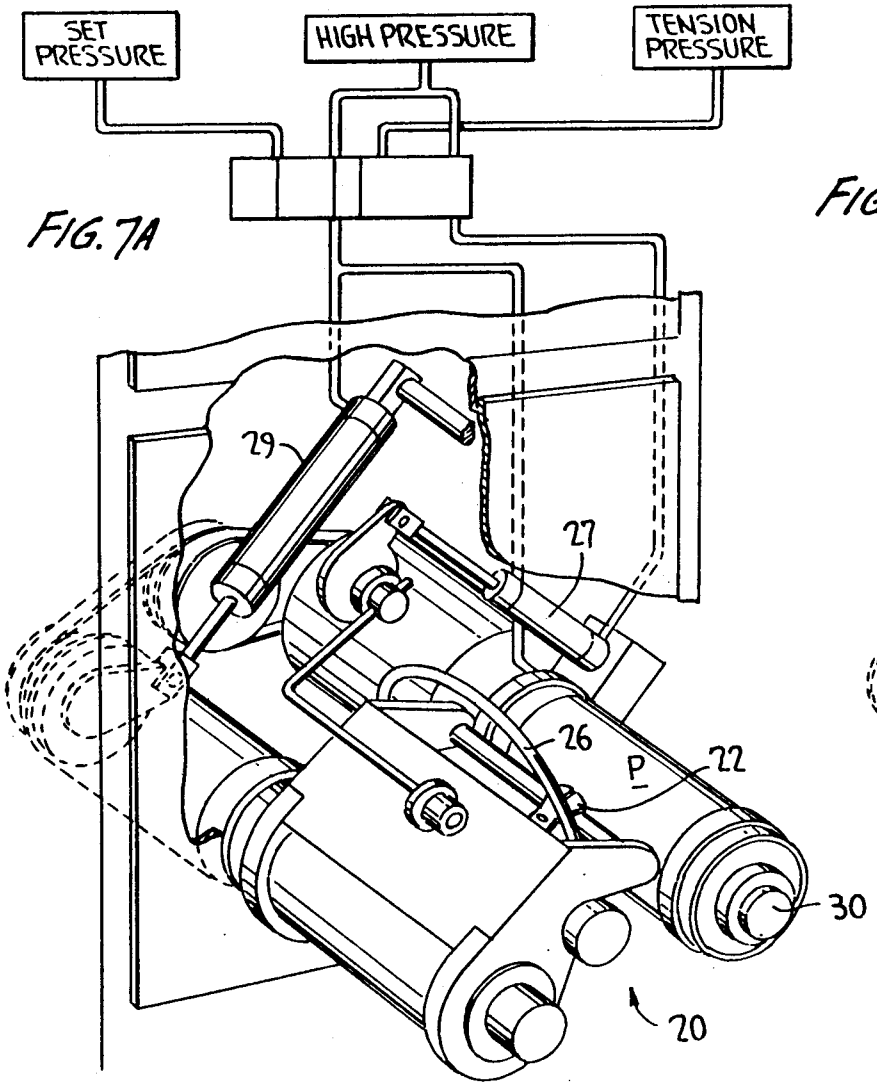

As shown in FIG. 6, and FIGS. 7A and 7B, the strand tension is controlled by first air cylinder 27 and the package pressure is controlled by second air cylinder 29. The air pressure for each of winding units 12 of the entire bank of seven winders 10 for the tension control and for the bail or package pressure control is fed from a line air supply 13 at the end of the entire bank through separate regulators 15 and 17. Accordingly, the pressure on the strand tension and the package pressure can be controlled on a plurality of units by a single adjustment rather than an individual adjustment of springs or the like at each unit. In FIG. 6 the robot which is to automatically doff each unit is not shown. Moreover, in FIG. 6 only one winding unit 12 is shown in detail. It is to be understood, however, that each of winding units 12 in FIG. 6 is to include a complete mechanism having all of the individual components as shown in the one illustrative unit.

Figure 4:
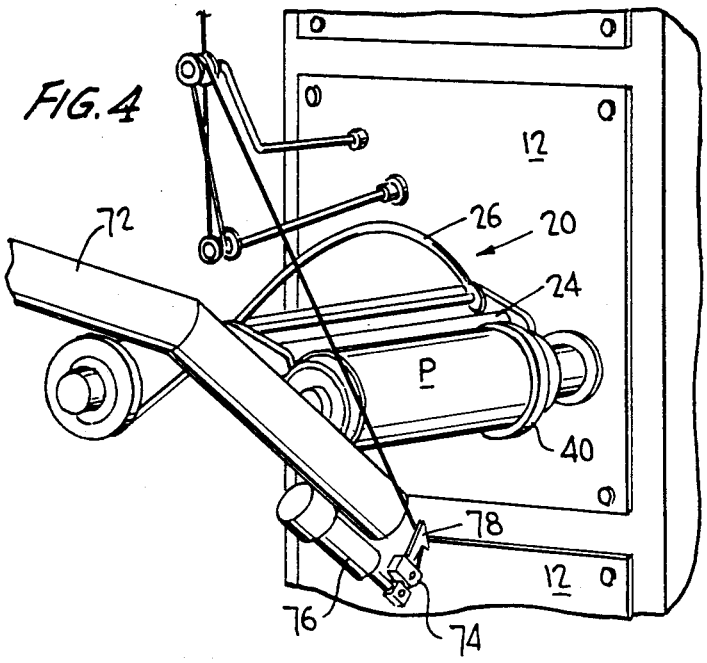
FIG. 4 is a view similar to the view of FIG. 3 but with the robot aspirator arm which is holding the strand moving across the front of the spindle, so as to engage the strand in a clamping mechanism on the spindle end to retain the strand end.
Figure 5:
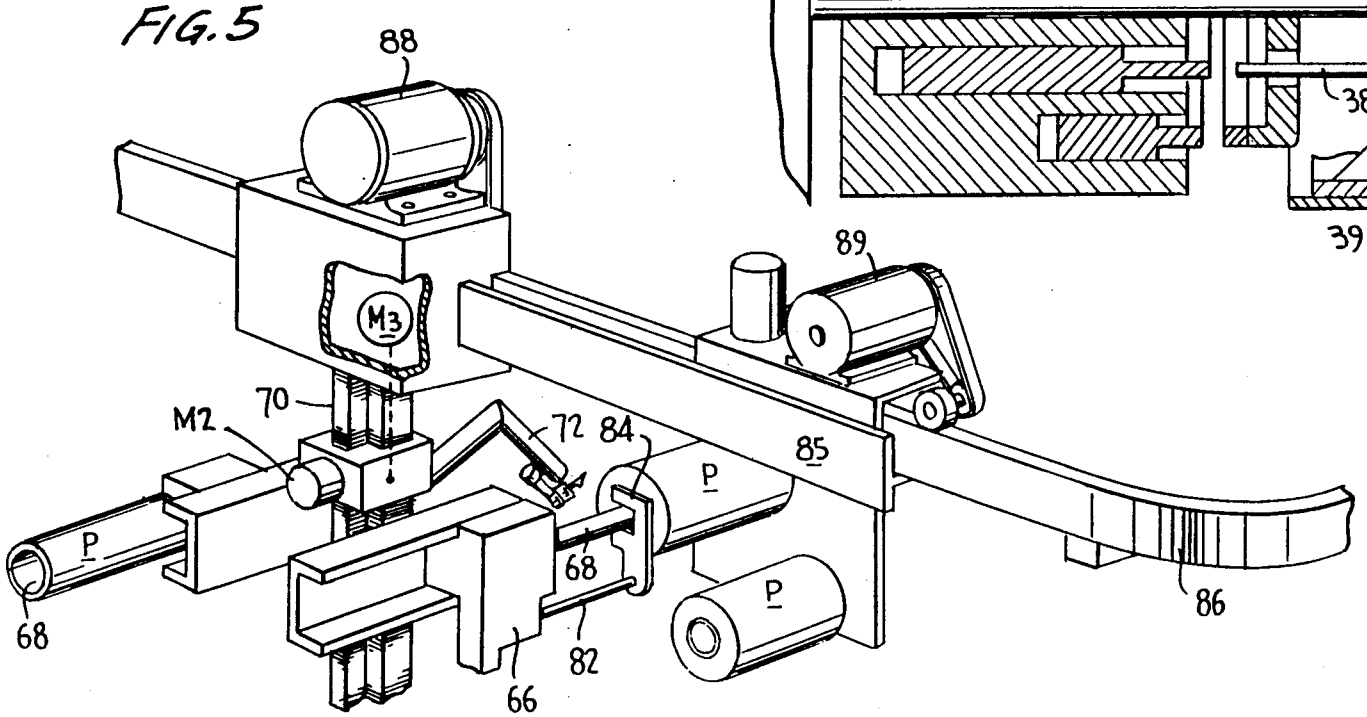
FIG. 5 is a perspective view of a trolley for moving the robot of FIG. 1, illustrates the power means for the robot, and a full package take-away system.

Referring next primarily to FIGS. 1, 3, 4, 5 and 8, a robot 60 designed to service the entire bank of winders 10 is guided by floor track 62 and, as best shown in FIG. 5, overhead track 86 carries and maintains robot 60 properly positioned at all times in front of winders 10. The robot is moved along tracks 62 and 86 by motor means 88, along the front of winders 10. The robot includes vacuum attachment means 64, which connects to vacuum source 14 on each of winders 10. Robot 60 further includes an indexing means 66 comprising a motor M2 and chain and sprocket mechanism, not shown, for indexing package holders 68 around robot frame 70. The vertical movement of the robot mechanism is actuated by motor M3 as shown in FIG. 5. The robot further includes an arm 72 for carrying a strand hold and cut mechanism generally shown at 74, positioned by motor M2. The hold and cut mechanism 74 comprises, as best shown in FIG. 1A, an air cylinder 76 for actuating holding and cutting clamp 78.

As best shown in FIG. 2, the robot includes an arm 80, carried by cylinder 82, having a cup-shaped retainer 84 which extends in under package P. When the arm 80 is raised and retracted, it will remove a package P from spindle 30 onto package holder 68. As shown in FIG. 4, robot arm 72, after removal of the full package and placing a new tube on spindle 30, will carry strand S across the front of spindle 30 for engagement with flange 32, best shown in FIG. 8.

Figure 8:
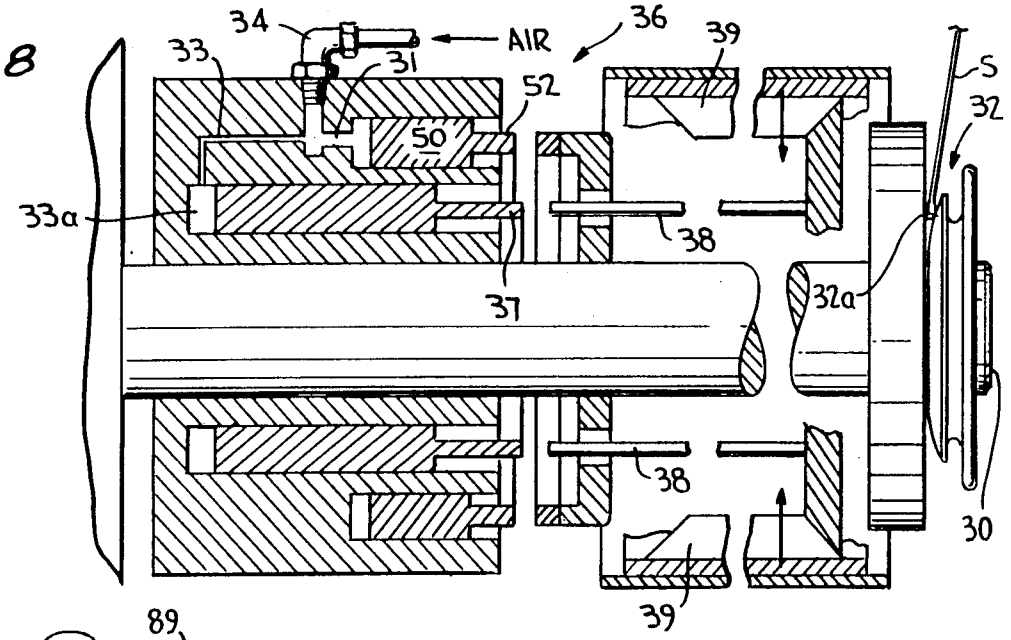
FIG. 8 is a detailed, partly sectional view of the spindle assembly used in the winding mechanism of this invention showing the pneumatic brake and clutch mechanism.

As shown in detail in FIG. 8, the rotation of spindle 30 is controlled by a pneumatic brake and clutch mechanism shown general at 36. Air flows through pipe 34 and then to passages 31 and 33. Passage 31 associated with cylinder 50, larger in diameter than passage 33, activates cylinder 50 which actuates brake 52. Air through passage 33 associated with cylinder **33*a*, actuates chuck release 38. Since passage 31 is larger than passage 33, it will be preferentially activated first, engaging the brake and stopping the spindle rotation. Once the brake is engaged, the air will flow through restricted passage 33, causing the piston in cylinder 33*a* to engage chuck rods 38 of spindle 30, which in turn will engage blades 39, releasing tube T from spindle 30. Threader flange 32 at the extreme end of spindle 30 is then in position for engaging strand S as it is carried across the front of spindle 30 by robot arm 72. As strand S crosses the front of the spindle, it will engage spring steel clamp 32*a*; and upon engagement, the clamp will sever the strand. With the strand engaged at the end of spindle 30, strand winding can be resumed. Upon resumption, the reverse sequence of operations occurs. Chuck rods 38 are first released through the dissipation of air in pipe 33, in turn activating blades 39, followed by the release of brake cylinder 50 through dissipation of air in conduit 31**. The package tube is again firmly held, the spindle is free to rotate and again ready for a winding operation.

Figure 11:
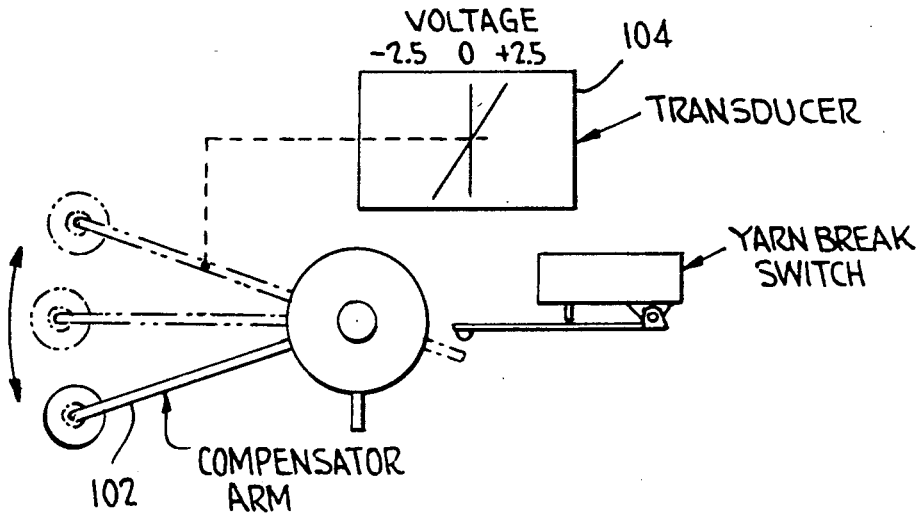
FIG. 11 illustrates schematically the positioning of the compensator arm relative to voltage in the doff and wind modes.
Figure 12:
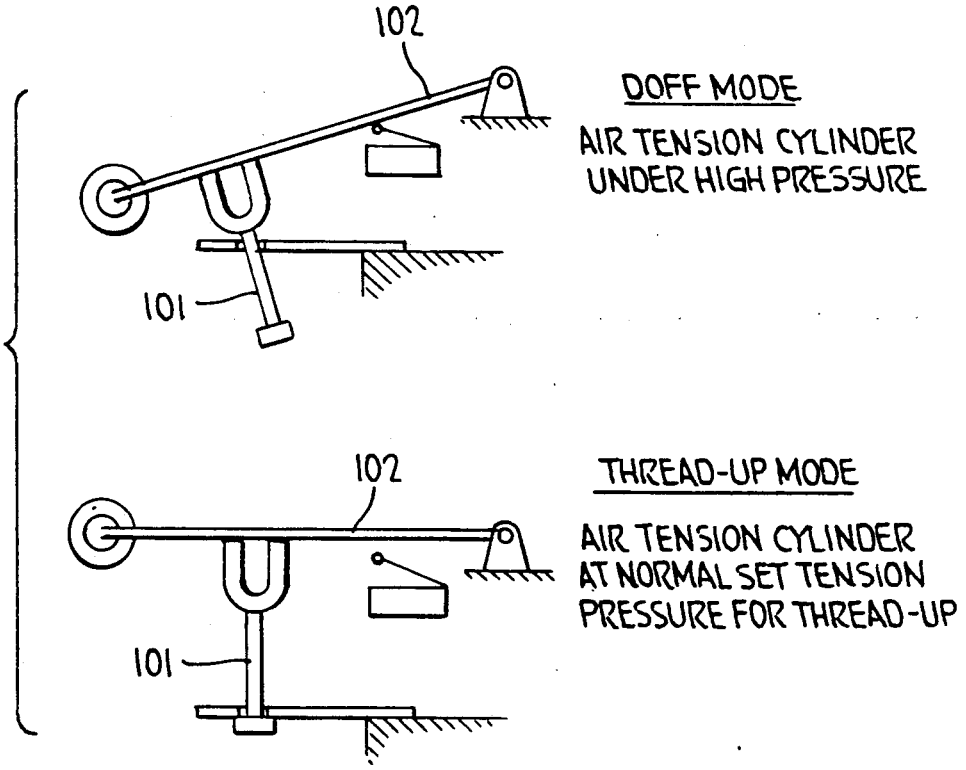
FIG. 12 illustrates schematically a magnetic hold-down means for the compensator arm of the winding unit when passing between the doff and wind modes.

A preferred drive system for the winding unit of the present invention is illustrated in FIGS. 11 and 12. When power is interrupted and then re-applied, the drive automatically places the spindle at a pre-selected speed—normally five percent higher than operating line speed. In the system illustrated in FIG. 11, when compensator arm 102 which controls the speed of the motor through a transducer 104, which is essentially a magnet within a coil of wire, passes through horizontal, the voltage output is also passing from a negative to a positive voltage and goes through zero. When it crosses zero, the drive assumes a normal operating winding mode.

As shown in FIG. 12, a magnetic hold-down means 101 is utilized for holding compensator arm 102 down in the doff mode. During the doffing operation and until the strand is placed into the thread-up flange 32 of spindle 30, the pre-set speed is faster than in the strand delivery mode, allowing strand S to pull the compensator arm 102 away from the magnet. As the compensator arm causes the transducer to cross zero voltage, the drive will enter the normal wind mode after it passes zero.

Figure 9:
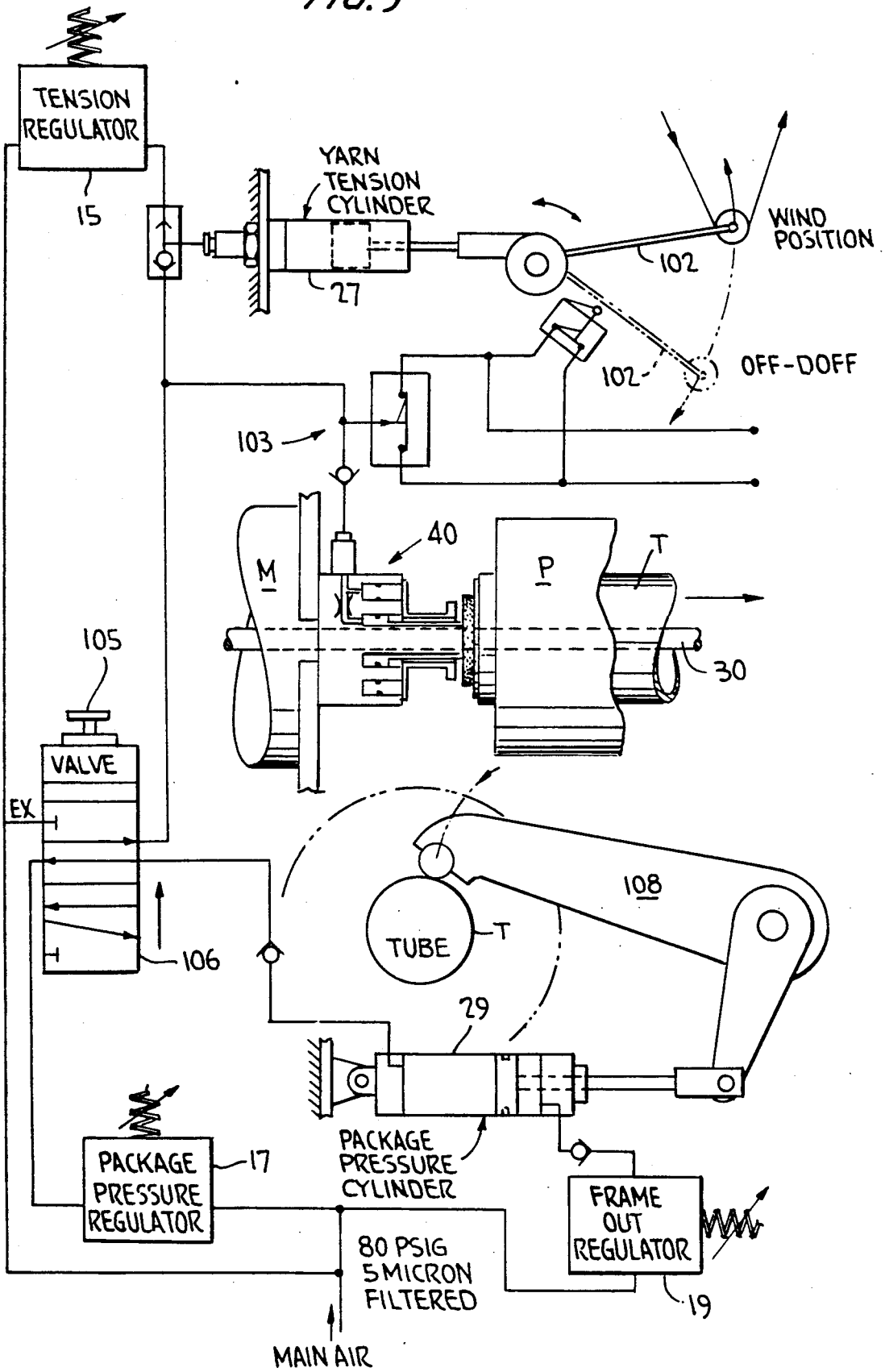
FIG. 9 is a schematic of the winding controls sequencing between the doff and wind modes.

The operation of the winding unit in reference to the sequence shown in the drawing is as follows:

FIG. 1—The robot 60 comes to a unit 12 where spindle 30 carries a full package to be doffed. It aligns with the spindle and connects lower part 64 to a vacuum source 14 on winder 10. At that point robot arm 72 comes into the strand S, cuts and aspirates the strand, and sends a signal through the spindle controls, as shown in FIG. 9, to activate push valve 105 to begin the doff sequence. The spindle doffing sequence begins.

FIG. 2—In the doffing sequence, roller bail 24 opens to the doff position, the motor power from motor M is disengaged, as seen in FIG. 9, the spindle brake is applied as shown in FIG. 8, and the tube holder is released also as shown in FIG. 8. In a timed relationship, the robot, through arm 80 and cup-shaped holder 84, removes the full package P and places it on package holder 68 of the robot.

Figure 3:
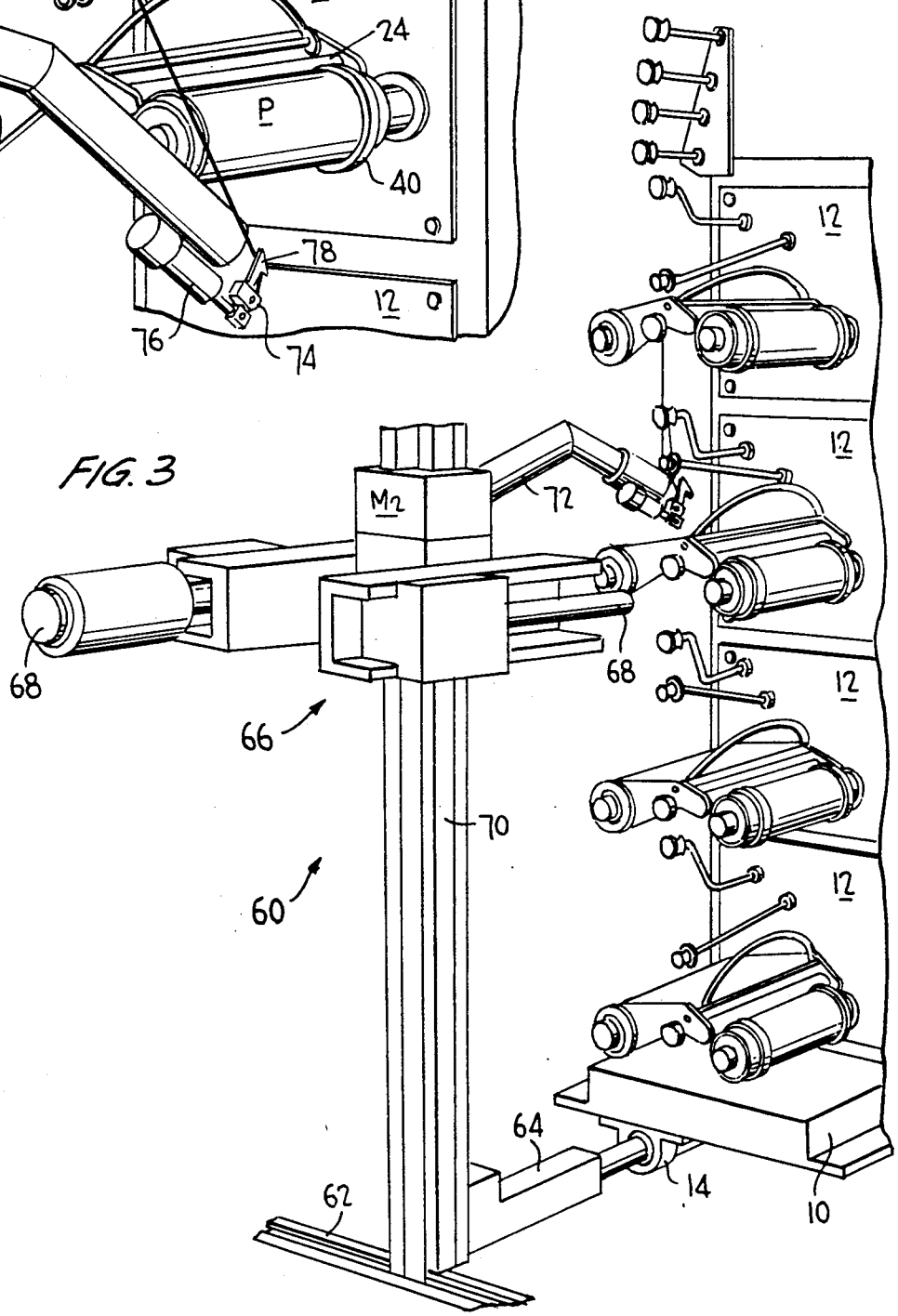
FIG. 3 is a perspective view of the assembly of FIG. 1 after the full package has been doffed, with the strand being held by the robot arm, and the robot indexed to place a new package tube on the spindle.

FIG. 3—The robot next indexes from a first position on frame 70 and places an empty tube T onto spindle 30. At this point full package P is away from the winding unit. The robot then initiates the re-start sequence by moving push valve 105 (FIG. 9) to its original position. The roller bail 24 closes, brake cylinder 50 releases, chuck 37 is closed, and spindle 30 assumes a preset speed.

FIG. 4—The robot then takes strand S that is being held in by aspirator and clamp 74 and brings it across so that it passes by the front of spindle 30 where it engages into a thread-up flange 32 (FIG. 8). The thread-up flange 32 cuts the strand, winds the tail, and begins winding a new package.

FIG. 5—Robot 60 then proceeds to carry full package P vertically up to a full package station PP carried on an overhead track 85 by motor M3. The full package is pushed off and the robot picks up a new empty tube. It then goes to the next spindle to begin the doffing sequence on a subsequent spindle.

FIGS. 7A and 7B—Both the strand tension and the package pressure are regulated for a multiplicity of spindles from a central point at the end of the line (FIG. 6). Air is fed from the regulators 15 and 17 to a multiplicity of units—one regulator 15 for the tension, a second regulator 17 for the package pressure. Each unit has two cylinders, 27 and 29. Cylinder 29 is connected so as to apply force between spindle 30 and the roller bail 24; and cylinder 27 is connected to apply force to the compensator arm 102 (FIG. 11 and 12), thereby controlling the tension on strand S. If the pressure to these same cylinders is modulated, other functions are affected. As shown in FIG. 7A, in the doff mode, when high-pressure air is applied to tension cylinder 27, it drives the compensator arm to a lower position (FIG. 11) where it is held by magnetic means as shown in FIG. 12. When high pressure is applied to the opposite side of package pressure cylinder 29, this creates the ability to reverse the direction and to move the roller bail 24 to the doff position. These pneumatic features, therefore, permit automation with a very simplified device.

FIG. 8—As shown in this figure, during the doffing sequence, air is introduced through inlet 34 to set brake 52. The entering air first performs the brake function and subsequently, after a predetermined delay, the chuck cylinder 37 is released. Quite simply, the air moves the cylinder 50 in contact with brake 52 first, and the chuck release system hits the expander rods 38 on spindle 30 to release blades 39, due to the different size of the air passages leading to the two cylinders. The operation is then reversed. Since removal of air from the system creates an opposite effect, it first releases the chuck blades 39, gripping the empty tube T, and releases brake 52, which allows for free rotation of the spindle 30.

FIG. 9—This figure diagrammatically illustrates the control system that integrates all of the functions of the winding unit. In addition to two regulators, 15 and 17, i.e., the strand tension regulator and the package pressure regulator, there is, optionally, a third frame-out regulator 19. All three regulators are at one central point at the end of the line as shown in FIG. 6, and air is fed from each regulator to all of the spindles of the winding units in the winder bank.

In the normal or winding mode, the yarn tension cylinder 15 is receiving a regulated pressure to control the tension. The brake and chuck functions, illustrated in FIG. 8, are inactive. The package pressure cylinder 29 has air pressures applied to it at both ends controlled by regulators 17 and 19 so that the motion of the frame 108 of the guide/traverse means 20 on tube T, or the strand package, is cushioned by means of a differential pressure producing a definitive regulated force, creating a given package pressure.

The doffing of the spindle, which can be done either manually or with a robot, is commenced by moving a push valve 105 to the doff mode. In the doff mode air is introduced to an interface switch 106 which opens an electrical circuit 103, thereby removing power from motor M. Air is simultaneously fed to the strand tensioning cylinder 27, placing higher pressure air on it, which forces the compensator arm 102 to its lowest position. Concurrently air is introduced to the brake-chuck device 40 which sequentially operates the brake and chuck release, as shown in FIG. 8. Also simultaneously, air is relieved from the rear of the package pressure cylinder 29, forcing the guide/traverse means 20 to raise from the package wind position and assume a doffing position. The mechanism now stands ready for the robot to doff.

After the robot has doffed a full package P and placed a new empty tube T on spindle 30, it signals the spindle again by returning the push valve 105 to its first position. When it does that, the whole process is reversed. The guide/traverse means 20 moves toward the winding position. The yarn tension cylinder 27 assumes normal pressures to give normal winding tensions; the chuck air is relieved so that the brake 52 is released, and the chuck closes.

Figure 10:
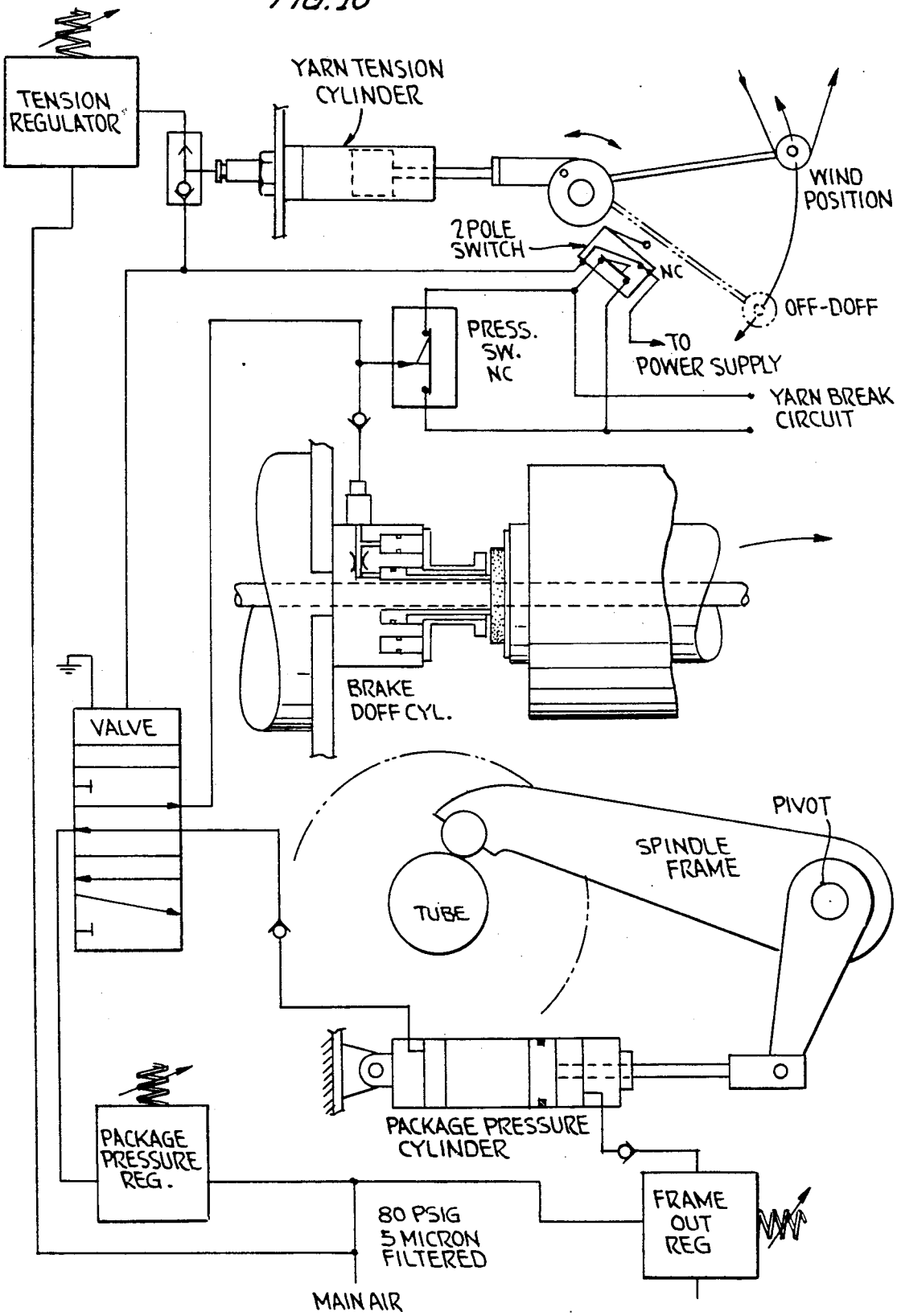
FIG. 10 is a schematic of an alternate winding control for that shown in FIG. 9.

FIG. 10—In an alternate mode, as shown in FIG. 10, the addition of another electrical contact on the compensator arm to control an electrically operated valve, in place of the push or toggle operated valve, allows the operation sequences to be activated by cutting the strand upstream of the compensator, allowing regulated air pressure on the compensator air cylinder to force the compensator arm down, contacting an electrical switch actuating the electrical valve and activating the winding machine doff mode, braking spindle rotation, releasing chuck for package removal. After a new empty tube has been placed onto the spindle, a strand is then placed around the compensator and roller, then placed at the end of the spindle for threading flange to capture, cut, and begin a new package. When strand is replaced around the compensator, the aspirator force picks up the compensator arm which is restrained by a magnetic hold-down to the position necessary to cause the pre-set speed to be activated, as shown in FIG. 12, item 101. Placing the strand into the thread-up flange at the end of the spindle causes the compensator arm to be pulled from the hold-down magnet, allowing the transducer to cross zero voltage and activating the wind mode.

FIGS. 11 and 12—At this point the yarn compensator arm is further restrained from freedom of motion by magnetic hold-down assembly 101. The hold-down assembly is of sufficient force to restrain release by the aspirator of robot 60, but will release when the spindle thread-up flange 32 is engaged.

The winding unit is now ready for the robot to begin the actual winding of the strand. Strand S is introduced to the thread-up flange 32. The thread-up flange puts out sufficient force to move the compensator off the magnet assembly 101 and through the horizontal position where the drive now enters the winding mode, and the operation is complete. A tail is built and a new package started.

The winding units 12 of the present invention are serviced by robot 60 sequentially rather than on a random basis. Accordingly, the number of winding units 12 to be serviced by a single robot is determined by the time it takes for the robot to service a unit and the time it takes to build a full package. In the embodiment shown in FIG. 6 there are seven winders 10 each having four winding units 12. Accordingly, there are twenty-eight spindles to be serviced. Typically the robot will require ninety seconds to service one spindle. All twenty-eight spindles, therefore, can be serviced over a period of thirty-two minutes. More typically, a single robot will service two-hundred or more winding units or spindles, depending on the speed in which the package is built. Thus, the servicing of two-hundred units on a ninety-second basis will require a five-hour period for servicing the full two-hundred units.

The winding units of the present invention are simple in construction and operation primarily in that they use a centralized air pressure for controlling of each strand tension, the braking of the spindle and releasing of the package on the spindle, and control of the bail pressure. This centralization permits the building of intelligence directly into the unit. Thus, the winding units of the present invention contain substantial intelligence. For example, in the prior art to doff a conventional winding unit required the following nine steps:

1. cut and aspirate a strand;
2. open the roller bail;
3. release package on a spindle;
4. remove package from the spindle (doff);
5. install new tube on the spindle;
6. secure new tube on the spindle;
7. lower roller bail;
8. set machine to preset speed; and
9. thread-up of the spindle.

Because of the intelligence built into the winders, the winding units of the present invention require only the performance of steps 1, 4, 5, and 9. Steps 2, 3, 6, 7, and 8 are carried out automatically by the winding unit by actuating a valve. This permits, therefore, the convenient automation of the unit with a robot. In the prior art automated units where the intelligence was contained completely or substantially completely in the robot, the robot was necessarily complex. According to the present invention, since substantial intelligence is contained in the winding unit, the robot need only cut and aspirate the strand, doff a full package, install a new tube on the spindle, and then thread-up the spindle. This permits, therefore, a robot which is relatively simple in construction.

The robot or automation can be controlled with commercially available program logic control units (PLC's). A particularly desirable PLC for use with the system of the present invention is an SLC 500, available from Allen-Bradley, Industrial Control Group, Milwaukee, Wis. 53204. The SLC 500 controls the on/off function of the winder; interfaces the winder with the automation, and, additionally, controls the timing and sequencing of the total operation, such as stopping the spindle, doffing of the full package, and the re-startup of the winding operation.

As will be apparent to one skilled in the art, various modifications can be made within the scope of the aforesaid description. Such modifications being within the ability of one skilled in the art form a part of the present invention and are embraced by the appended claims.

It is claimed:

1. Method of operating a tension compensator take-up machine including the steps of (a) advancing at least one strand from a supply to a rotating spindle;
(b) traversing said strand with a traverse means to wind said strand into a package on said spindle;
(c) controlling said strand tension by engaging said strand on a tension compensator arm;
(d) doffing a full strand package by
  (i) cutting said strand, thereby initiating the steps of arresting the rotation of said package, releasing said package on said spindle, and moving said traverse means from a wind position to a doff position; and
  (ii) removing said package from said spindle;
(e) inserting an empty tube on said spindle;
(f) positioning said strand around said tension compensator arm, thereby restarting said spindle rotation at a pre-set speed, securing said empty tube, moving said transverse means to the wind position; and
(g) bringing said strand across said spindle to engage and retain said strand on said spindle, restarting said winding.

2. The method of claim 1 wherein said advancing of said strand is continuous and further including aspirating said continuously advanced strand during steps (d)–(g).

3. The method of claim 2 including extruding said strand from said supply.

4. The method of claim 1 wherein the bringing of said strand across said spindle includes the step of winding a tail.

5. Method of operating a tension compensator take-up machine including the steps of (a) advancing at least one strand from a supply to a rotating spindle;
(b) traversing said strand with a traverse means to wind said strand into a package on said spindle;
(c) controlling said strand tension by engaging said strand on a tension compensator arm;
(d) doffing a full strand package by
  (i) activating switch means which drives said compensator arm downward to a package doff mode and thereby initiating the steps of arresting the rotation of said package, releasing said package on said spindle, and moving said traverse means from a wind position to a doff position;
  (ii) cutting said strand; and
  (iii) removing said package from said spindle;
(e) inserting an empty tube on said spindle;
(f) deactivating said switch means which raises said compensator arm to a wind mode, thereby restarting said spindle rotation at a pre-set speed, securing said empty tube, moving said transverse means to the wind position; and
(g) bringing said strand across said spindle to engage and retain said strand on said spindle, restarting said winding.

6. The method of claim 5 wherein the cutting of said strand is downstream of said compensator arm.

7. The method of claim 5 wherein said advancing of said strand is continuous and further including aspirating said continuously advanced strand during steps (d)–(g).

8. The method of claim 7 including extruding said strand from said supply.

9. The method of claim 7 wherein the bringing of said strand across said spindle includes the step of winding a tail.

10. The method of claim 5 including operating a robot to accomplish steps (d)–(g).

11. Method of operating a tension compensator take-up machine including the steps of (a) advancing at least one strand from a supply to a rotating spindle;
(b) traversing said strand with a traverse means to wind said strand into a package on said spindle;
(c) controlling said strand tension by engaging said strand on a tension compensator arm;
(d) doffing a full strand package by
  (i) robot means cutting and aspirating said strand downstream of said compensator arm thereby leaving said strand engaged with said compensator arm;

(ii) robot means initiating the steps of arresting the rotation of said package, releasing said package on said spindle, and moving said traverse means from a wind position to a doff position; and (iii) robot means removing said package from said spindle;

(e) donning and starting a new package by (i) robot means inserting an empty tube onto said spindle;

(ii) robot mean initiating the sequence of starting said spindle rotation at a preset speed, securing said empty tube on said spindle, and moving said traverse means to the wind position; and (iii) robot means bringing said strand across said spindle to engage and retain said strand on said spindle, restarting said winding.

12. The method of claim 11 including extruding said strand from said supply.

13. The method of claim 11 wherein the bringing of said strand across said spindle includes the step of winding a tail.

* * * * *